US007147036B2

(12) United States Patent
Ike

(10) Patent No.: US 7,147,036 B2
(45) Date of Patent: Dec. 12, 2006

(54) HEAT EXCHANGER, A METHOD FOR PRODUCING THE SAME AND A DEHUMIDIFIER CONTAINING THE SAME

(75) Inventor: Hidetoshi Ike, Yokohama (JP)

(73) Assignee: Kankyo Co., Ltd., Kanagawa (JP)

( * ) Notice: Subject to any disclaimer, the term of this patent is extended or adjusted under 35 U.S.C. 154(b) by 0 days.

(21) Appl. No.: 11/339,446

(22) Filed: Jan. 26, 2006

(65) Prior Publication Data

US 2006/0124286 A1 Jun. 15, 2006

Related U.S. Application Data

(62) Division of application No. 10/948,332, filed on Sep. 24, 2004, now Pat. No. 7,025,119, which is a division of application No. 10/110,180, filed as application No. PCT/JP00/05355 on Aug. 10, 2000, now Pat. No. 6,814,132.

(51) Int. Cl.
*F28D 19/00* (2006.01)

(52) U.S. Cl. ..... 165/10; 165/140; 165/165; 165/166

(58) Field of Classification Search ..... 165/10, 165/140, 165, 166
See application file for complete search history.

(56) References Cited

U.S. PATENT DOCUMENTS

| | | | |
|---|---|---|---|
| 2,081,678 | A | 5/1937 | Rosenblad |
| 3,882,934 | A | 5/1975 | Knoos et al. |
| 3,907,028 | A | 9/1975 | Lawson |
| 4,084,633 | A | 4/1978 | Strindehag |
| 4,089,370 | A | 5/1978 | Marchal |
| 4,200,441 | A | 4/1980 | Honmann et al. |
| 4,391,616 | A | 7/1983 | Imamura |
| 4,883,117 | A * | 11/1989 | Dobbs et al. ..... 165/164 |

(Continued)

FOREIGN PATENT DOCUMENTS

| | | |
|---|---|---|
| FR | 2045691 | 3/1971 |

(Continued)

OTHER PUBLICATIONS

"High Performance Heat Exchanger Data Book" published by Energy Saving Center, pp. 194-195.

*Primary Examiner*—Henry Bennett
*Assistant Examiner*—Nihir Patel
(74) *Attorney, Agent, or Firm*—Birch, Stewart, Kolasch and Birch, LLP

(57) ABSTRACT

Two passages adjacent to each other via walls are formed spirally, and heat is exchanged between fluids passing through the passages via the walls. Upper and lower end faces of the spiral passages are covered with end plates, and the spiral passages and the end plates are sealed air-tightly. The end plates have a first passage inlet opening only to the first passage, a first passage outlet opening only to the first passage, a second passage inlet opening only to the second passage and a second passage outlet opening only to the second passage. Each of the inlets and outlets is open to every turn of the spiral passage. A first fluid entering the passage from the first passage inlet passes through the first passage for less than one turn only and is discharged from the first passage outlet. A second fluid entering the passage through the second passage inlet passes through the second passage for less than one turn only and is discharged from the second passage outlet. Thus, since the fluids entering from the openings pass through the passages for less than one turn only, the pressure loss is small, throughput is high, and the power used for the processing can be reduced.

3 Claims, 4 Drawing Sheets

U.S. PATENT DOCUMENTS

| | | | | |
|---|---|---|---|---|
| 5,273,106 | A | 12/1993 | Drake | |
| 5,316,747 | A * | 5/1994 | Pow et al. | 423/247 |
| 5,326,537 | A * | 7/1994 | Cleary | 422/173 |
| 5,456,889 | A * | 10/1995 | Pow et al. | 422/173 |
| 5,690,763 | A * | 11/1997 | Ashmead et al. | 156/60 |
| 5,787,974 | A * | 8/1998 | Pennington | 165/164 |
| 5,787,977 | A * | 8/1998 | Yuasa et al. | 165/284 |
| 6,233,824 | B1 * | 5/2001 | Dobbs et al. | 29/890.03 |
| 6,263,961 | B1 * | 7/2001 | Antoine | 165/164 |
| 6,282,371 | B1 * | 8/2001 | Martin et al. | 392/490 |
| 6,397,944 | B1 | 6/2002 | Caldwell | |
| 6,532,339 | B1 * | 3/2003 | Edgar et al. | 392/490 |
| 6,607,027 | B1 * | 8/2003 | Bosch et al. | 165/163 |
| 6,644,391 | B1 * | 11/2003 | Fourt et al. | 165/164 |
| 6,745,822 | B1 | 6/2004 | Mitchell | |
| 6,814,132 | B1 * | 11/2004 | Ike | 165/10 |

FOREIGN PATENT DOCUMENTS

| | | | |
|---|---|---|---|
| JP | 56-82384 | A | 7/1981 |
| JP | 5-264181 | A | 10/1993 |
| JP | 10-277678 | A | 10/1998 |

* cited by examiner

HEAT EXCHANGER, A METHOD FOR PRODUCING THE SAME AND A DEHUMIDIFIER CONTAINING THE SAME

This application is a division of U.S. patent application Ser. No. 10/948,332 filed Sep. 24, 2004 now U.S. Pat. No. 7,025,119, which is a division of U.S. patent application Ser. No. 10/110,180 filed Apr. 10, 2002, now U.S. Pat. No. 6,814,132, which application is the National Phase under 35 U.S.C. § 371 of PCT International Application No. PCT/JP00/05355 designating the United States of America and having an International Filing date of Aug. 10, 2000.

TECHNICAL FIELD

Heat exchangers wherein fluids are made to pass through two spiral passages and heat is exchanged between these fluids (the heat exchanger is hereinafter referred to as "spiral heat exchanger" for convenience) are known. For example, Japanese Laid-open Patent Application (Kokai) No. 56-82384 discloses a heat exchanger comprising two spiral passages. Fluids are made to pass through the respective passages in counter directions so as to exchange heat through the walls of the passages. A similar heat exchanger is also described in "High Performance Heat Exchanger Data Book", published by Energy Saving Center, page 195.

With the conventional spiral heat exchangers, heat exchange is carried out while passing the fluids through the entire passages, they have an advantage that the efficiency of heat exchange is high. However, since the fluids are made to enter the passages from the start and end points thereof, respectively, and made to pass all the way to the respective outlets, the pressure loss (air-flow resistance) is large, so that the amount of the fluid which can be processed in a unit time is small, and so the throughput is small. To increase the throughput, it is necessary to introduce the fluids into the passages with a high pressure, so that a strong motor is necessary and the electricity consumption is large.

DISCLOSURE OF THE INVENTION

Accordingly, an object of the present invention is to provide a heat exchanger having a high efficiency of heat exchange comparable to the conventional heat exchangers utilizing spiral passages, while having a smaller pressure loss (air-flow resistance) than the conventional heat exchangers of this type, and to provide a method for producing the heat exchanger, as well as to provide a dehumidifier utilizing the heat exchanger.

The present inventors have determined that by discharging the fluid after passing the fluid through the spiral passage for less than one turn only, the overall heat exchanging efficiency is as high as those of the conventional spiral heat exchangers, while the pressure loss (air-flow resistance) is reduced and so the throughput is largely increased, thereby completing the present invention.

The present invention provides a heat exchanger comprising a first spiral passage, a second spiral passage formed along said first passage, which is adjacent to said first passage via walls; first and second end plates which cover both end faces of said first and second passages, respectively; a first passage inlet consisting essentially of a group of openings formed in a first region continuous along the radial direction in said first end plate, said openings being open only to said first passage; a first passage outlet consisting essentially of a group of openings formed in a second region continuous along the radial direction in said first or second end plate said openings being open only to said first passage; a second passage inlet consisting essentially of a group of openings formed in a third region continuous along the radial direction in said first or second end plate, said openings being open only to said second passage; and a second passage outlet consisting essentially of a group of openings formed in a fourth region continuous along the radial direction in said first or second end plate, said openings being open only to said second passage; said first passage being tightly closed except for said first passage inlet and said first passage outlet; said second passage being tightly closed except for said second passage inlet and said second passage outlet; a first fluid entering said first passage from said first passage inlet and being discharged from said first passage outlet after passing through said first passage for less than one turn; a second fluid entering said second passage from said second inlet and being discharged from said second passage outlet after passing through said second passage for less than one turn whereby heat is exchanged between said first and second fluids through said walls during said first and second fluids passing through said first and second passages, respectively.

The present invention also provides a heat exchanger comprising a first spiral passage; a second spiral passage formed along said first passage, which is adjacent to said first passage via walls; first and second end plates which cover both end faces of said first and second passages, respectively, a first passage inlet consisting essentially of a group of openings formed in a first region continuous along the radial direction in said first end plate, which openings are open only to said first passage; a first passage outlet consisting essentially of a group of openings formed in a second region continuous along the radial direction in said first or second end plate, which openings are open only to said first passage; a second passage inlet consisting essentially of a group of openings formed in a third region continuous along the radial direction in said first or second end plate, which third region is located at an area other than said first and second regions, which openings are open only to said second passage, and a second passage outlet consisting essentially of a group of openings formed in a fourth region continuous along the radial direction in said first or second end plate, which fourth region is located at an area other than said first and second regions, and formed in the first or second end plate other than the one in which said second passage Inlet is formed said openings being open only to said second passage; said first passage being tightly closed except for said first passage inlet and said first passage outlet; said second passage being tightly closed except for said second passage inlet and said second passage outlet; a first fluid entering said first passage from said first passage inlet and discharged from said first passage outlet after passing through said first passage for less than one turn; a second fluid entering said second passage from said second inlet and discharged from said second passage outlet after passing through said second passage in axial direction whereby heat is exchanged between said first and second fluids through said walls during said first and second fluids passing through said first and second passages, respectively.

The present invention further provides a heat exchanger comprising a first spiral passage; a second spiral passage formed along said first passage, which is adjacent to said first passage via walls; first and second end plates which cover both end faces of said first and second passages, respectively; a first passage inlet consisting essentially of a group of openings formed in a first region located at an outer half or about an inner half of an area continuous along the radial direction in said first end plate, said openings being open only to said first passage; a first passage outlet consisting essentially of a group of openings formed in a second region located at an outer half of an area continuous along the radial direction in said first or second end plate when said first passage inlet is located at said outer half of said radially continuous area, or located at an inner half of an area continuous along the radial direction in said first or second end plate when said first passage inlet is located at said inner half of said radially continuous area, which openings are open only to said first passage; a second inlet of said first passage consisting essentially of a group of openings formed in a third region located at an outer half of an area continuous along the radial direction in said first or second end plate when said first passage inlet is located at said inner half of said radially continuous area, or located at an inner half of an area continuous along the radial direction in said first or second end plate when said first passage inlet is located at said outer half of said radially continuous area, which openings are open only to said first passage; a second outlet of said first passage consisting essentially of a group of openings formed in a fourth region located at an outer half of an area continuous along the radial direction in said first or second end plate when said second inlet of said first passage is located at said outer half of said radially continuous area, or located at an inner half of an area continuous along the radial direction in said first or second end plate when the second inlet of said first passage is located at said inner half of said radially continuous area, which openings are open only to said first passage; a second passage inlet consisting essentially of a group of openings formed in a fifth region continuous along the radial direction to said first or second end plate, said fifth region being formed in an area other than said first to fourth regions, said openings being open only to said second passage; a second passage outlet consisting essentially of a group of openings formed in a sixth region continuous along the radial direction in said first or second end plate, said sixth region being formed in an area other than said first to fourth regions, and being formed in the first or second end plate other than the one in which said second passage inlet is formed, which openings are open only to said second passage, and a third passage which air-tightly connects said first outlet of said first passage and said second inlet of said first passage; said first passage being tightly closed except for said first and second inlets of the first passage and said first and second outlets of the first passage; said second passage being tightly closed except for said second passage inlet and said second passage outlet; a first fluid entering said first passage from said first passage inlet and entering said third passage from said first passage outlet after passing through said first passage for less than one turn, then entering said first passage from said second inlet of said first passage, and discharged from said second outlet of said first passage after passing through said first passage for less than one turn, a second fluid entering said second passage from said second inlet and discharged from said second passage outlet after passing through said second passage in an axial direction, whereby heat is exchanged between said first and second fluids through said wall while said first and second fluids pass through said first and second passage, respectively.

The present invention still further provides a method for producing the heat exchanger of the present invention comprising the steps of holding first and second end plates in a parallel, in which said openings are formed, each of which having a spiral ridge; stacking two films composed of a material having flexibility and elasticity; and winding said films such that each film contacts each ridge while bending said film such that central portion in the direction perpendicular to longitudinal direction of said film protrudes in the outer direction of said spiral. The present invention further provides a dehumidifier using the heat exchanger of the present invention.

The present invention provides a novel heat exchanger in which the pressure loss is small and the throughput is large and the heat-exchanging efficiency is as high as that of conventional spiral heat exchanger. By the production method according to the present invention, the spiral heat exchanger according to the present invention may be produced inexpensively and in a large quantity. Further, by the present invention, a dehumidifier is provided having a high heat-exchanging efficiency, and a low electricity consumption.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

BEST MODE FOR CARRYING OUT THE INVENTION

Figure 1:
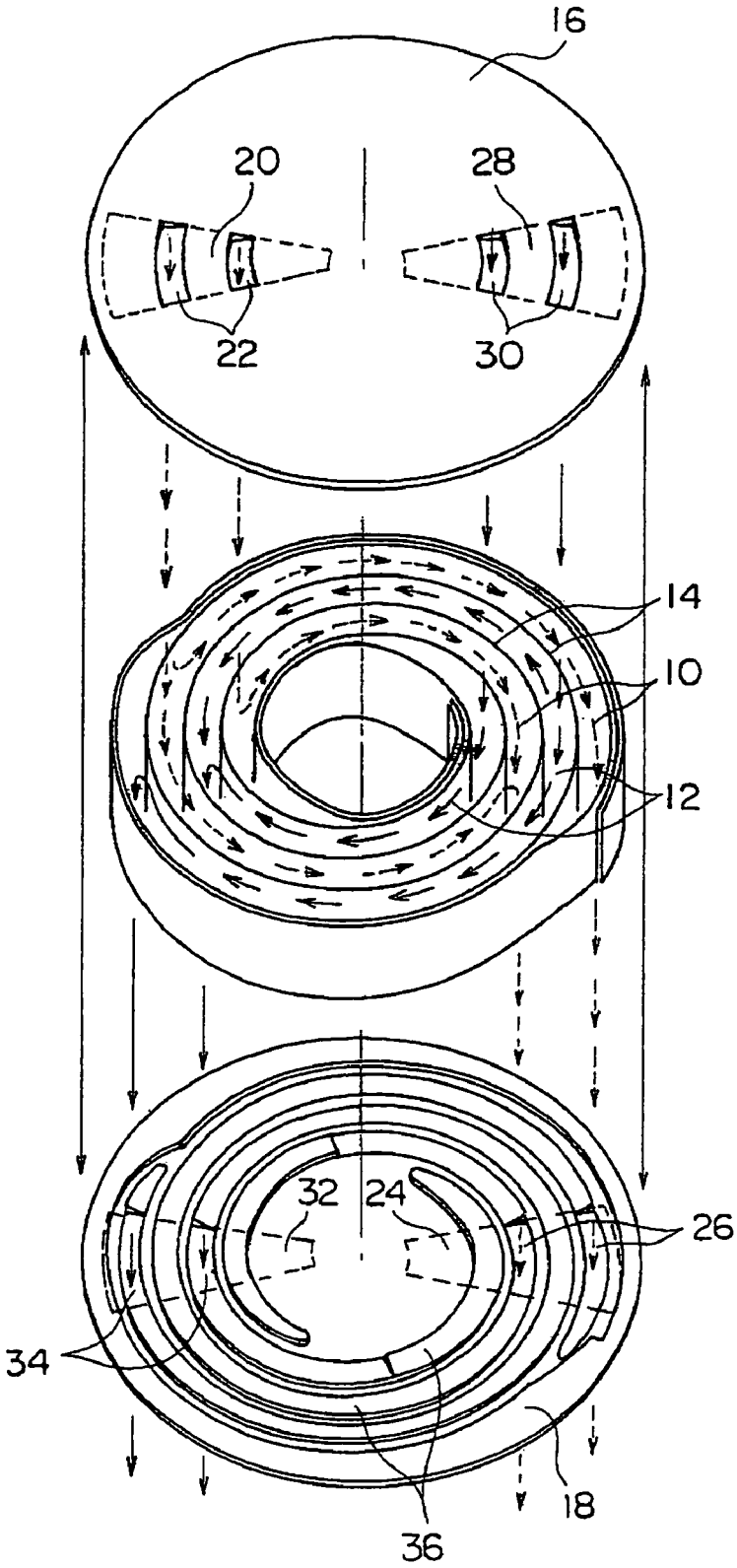
FIG. 1 is a schematic exploded view showing a preferred embodiment of the present invention.

FIG. 1 shows a preferred embodiment of the heat exchanger according to the present invention. FIG. 1 separately shows part of the passages and the two end plates provided on both end faces thereof.

The heat exchanger according to the present invention comprises a first spiral passage 10, and a second spiral passage 12 formed alongside the first passage, adjacent to the first passage with walls therebetween. The walls are preferably made of a film such as a plastic, which has an appropriate rigidity, flexibility and elasticity. The plastic material is not restricted, and preferred examples thereof include polypropylenes and polystyrenes. The thickness of the film is not restricted, and usually 20 to 1000 μm is appropriate. The shape of the spiral is not restricted, and any spiral shape may be employed. Thus, the spiral may be an ordinary spiral close to a true circle, or may have an oval or polygonal configuration.

The end faces of these passages are covered with a first end plate 16 and a second end plate 18, respectively. The term "end faces" means the bottom face and the top face of the substantially cylindrical shape formed by the first passage 10 and the second passage 12. The first passage 10 and the second passage 12 are air-tightly sealed with the first end plate 16 and the second end plate 18.

In the first end plate 16, a first passage inlet 22 consisting essentially of a group of openings is formed in a first region 20, continuous along the radial direction in the first end plate, which openings are open only to the first passage. Although the number of the openings in the embodiment shown in FIG. 1 is only 2 because each passage is wound only two turns for the purpose of simplicity, since in the actual heat exchanger, the passages are usually wound 10 to 100 turns, the number of the openings is accordingly more than that shown in FIG. 1. In the embodiment shown in FIG. 1, the first region is substantially a sector, but the shape of the first region is not restricted thereto. For example, it may have an arbitrary shape such as a rectangle or the like. However, since the distance between the inlet and the outlet below described is short in the vicinity of the center of the end plate 16 (the amount of the fluid to be processed per unit area of the wall is large), heat exchange is not well performed on the fluid supplied to this region. Therefore, in the vicinity of the center, it is preferred to make the size of the openings as small as possible so as to make the distance between the opening and the outlet as long as possible. Therefore, the shape of the first region may preferably be a sector as shown in FIG. 1. Alternatively, to avoid the problem that the distance between the inlet and the outlet is short, the first region may not extend to the vicinity of the center of the end plate 16. For example, the first region may be formed in the end plate 16 in the outer ⅔'s region in the radial direction of the end plate 16 (In this case, no openings are formed in the turns of the first passage, which run in the vicinity of the center). The openings may preferably be formed in all of the turns of the first passage, which cross the first region. However, if the openings are formed in not less than 80% of the turns of the first passage, which cross the first region, there is substantially no problem. Although the size of the openings is not restricted, if it is too small, the throughput is small, and if it is too large, the distance of the passage between the inlet and the outlet in which heat exchange is carried out is short (the amount of the fluid to be processed in a unit area of the wall is large), so that the heat-exchanging efficiency is low. Thus, the size of the openings may preferably be about 15 to 60 degrees in terms of the central angle (the angle formed by the both edges of the arc in the circumferential direction of the opening and the center of the end plate).

On the other hand, in the second end plate 18, a first passage outlet 26 consisting essentially of a group of openings is formed in a second region 24 continuous along the radial direction in the second end plate, which openings are open only to the first passage. Although the number of the openings in the embodiment shown in FIG. 1 is only 2 because each passage is wound only two turns for the purpose of simplicity, in the actual heat exchanger, the passages are usually wound 10 to 100 turns, so that the number of the openings is more than that shown in FIG. 1 accordingly. In the embodiment shown in FIG. 1, the second region is substantially sector, but the shape of the second region is not restricted thereto. For example, it may have an arbitrary shape such as rectangle or the like. However, since the distance between the above-mentioned first passage inlet 22 and the first passage outlet 26 is short in the vicinity of the center of the end plate 18 (the amount of the fluid to be processed per a unit area of the wall is large), heat exchange is not well performed on the fluid supplied to this region. Therefore, in the vicinity of the center, it is preferred to make the sizes of the openings as small as possible so as to make the distance between the opening and the outlet as long as possible. Therefore, the shape of the second region may preferably be a sector as shown in FIG. 1. Alternatively, to avoid the problem that the distance between the inlet and the outlet is short, the second region may not extend to the vicinity of the end plate 18. For example, the second region may be formed in the outer ⅔ region in the radial direction in the end plate 18 (In this case, no openings are formed in the turns of the first passage, which run in the vicinity of the center). The openings may preferably be formed in all of the turns of the first passage, which cross the second region. However, if the openings are formed in not less than 80% of the turns of the first passage, which cross the second region, there is substantially no problem. Although the size of the openings is not restricted, if it is too small, the throughput is small, and if it is too large, the distance of the passage between the inlet and the outlet in which heat exchange is carried out is too short (the amount of the fluid to be processed in a unit area of the wall is large), so that the heat-exchanging efficiency is low. Thus, the size of the openings may preferably be about 15 to 60 degrees in terms of the central angle (the angle formed by the both edges of the arc in the circumferential direction of the opening and the center of the end plate).

In the embodiment shown in FIG. 1, the first passage inlet 22 is formed in the left side of the end plate 16, and the first passage outlet 26 is formed in the right side of the end plate 18, so that the first passage inlet 22 and the first passage outlet 26 are formed at the positions shifted by about 180 degrees from each other. However, the positional relationship between the first passage inlet 22 and the first passage outlet 26 is not restricted thereto, and an arbitrary positional relationship may be employed. However, if the fluid entering from the inlet, is discharged immediately from the outlet, the heat-exchanging efficiency is low. Therefore, it is preferred to arrange the inlet and the outlet such that the fluid entering from the first passage inlet is discharged from the first passage outlet after passing through the first passage preferably for about 120 to 340 degrees, more preferably for about 150 to 340 degrees. In any event, the fluid entering from the first passage inlet 22 is discharged from the first passage outlet 26 after passing through the first passage 10 for less than one turn only (i.e., less than 360 degrees). In cases where the inlet and the outlet are arranged at positions shifted by a degree which is not about 180 degrees, it is preferred to give an initial velocity to the fluid supplied to the inlet, in the direction for passing through the longer passage, in order to prevent the fluid from being discharged from the outlet after passing through the shorter part of the passage. If it is desired to avoid such complexity, it is preferred to arrange the first passage inlet 22 and the first passage outlet 26 at positions shifted by about 180 degrees (i.e., 150 to 210 degrees) as shown in FIG. 1. It should be noted that in the embodiment shown in FIG. 1, the first passage inlet 22 and the first passage outlet 26 are formed in the different end plates, but they may also be formed in the same end plate.

In the first end plate 16, a second passage inlet 30 is formed consisting essentially of a group of openings formed in a third region 28 continuous along the radial direction, which third region 28 is located at a position other than the first region 20, which openings are open only to the second passage 12. Although the number of the openings in the embodiment shown in FIG. 1 is only 2 because each passage is wound only two turns for the purpose of simplicity, in the actual heat exchanger, the passages are usually wound 10 to 100 turns, so that the number of the openings is more than that shown in FIG. 1. In the embodiment shown in FIG. 1, the third region has a substantially sector configuration, but the shape of the third region is not restricted thereto. For example, it may have an arbitrary shape such as rectangle or the like. However, since the distance between the inlet and the outlet below described is short in the vicinity of the center of the end plate 16 (the amount of the fluid to be processed per a unit area of the wall is large), heat exchange is not well performed on the fluid supplied to this region. Therefore, in the vicinity of the center, it is preferred to make the sizes of the openings as small as possible so as to make the distance between the opening and the outlet as long as possible. Therefore, the shape of the third region may preferably be that of a sector as shown in FIG. 1. Alternatively, to avoid the problem that the distance between the inlet and the outlet is short, the third region may be designed so as to not extend to the vicinity of the center of the end plate 16. For example, the third region may be formed in the outer ⅔'s region in the radial direction in the end plate 16 (In this case, no openings are formed in the turns of the second passage, which run in the vicinity of the center). The openings may preferably be formed in all of the turns of the second passage which cross the third region. However, if the openings are formed in not less than about 80% of the turns of the second passage, which cross the third region, there is substantially no problem. Although the size of the openings is not restricted, if it is too small, the throughput is small, and if it is too large, the distance of the passage between the inlet and the outlet in which heat exchange is carried out is short (the amount of the fluid to be processed in a unit area of the wall is large), so that the heat-exchanging efficiency is low. Thus, the size of the openings may preferably be about 15 to 60 degrees in terms of the central angle (the angle formed by the both edges of the arc in the circumferential direction of the opening and the center of the end plate).

On the other hand, in the second end plate 18, a second passage outlet 34 is formed consisting essentially of a group of openings formed in a fourth region 24 continuous along the radial direction in the first end plate, which fourth region is located at a position other than the above-mentioned second region 24, which openings are open only to the second passage. Although the number of the openings in the embodiment shown in FIG. 1 is only 2 because each passage is wound only two turns for the purpose of simplicity, in the actual heat exchanger, the passages are usually wound 10 to 100 turns, so that the number of the openings is more than that shown in FIG. 1. In the embodiment shown in FIG. 1, the fourth region has a substantially sector configuration, but the shape of the fourth region is not restricted thereto. For example, it may have an arbitrary shape such as rectangle or the like. However, since the distance between the above-mentioned second passage inlet 30 and the second passage outlet 34 is short in the vicinity of the center of the end plate 18 (the amount of the fluid to be processed per a unit area of the wall is large), heat exchange is not well performed on the fluid supplied to this region. Therefore, in the vicinity of the center, it is preferred to make the sizes of the openings as small as possible so as to make the distance between the inlet and the outlet as long as possible. Therefore, the shape of the fourth region may preferably be a sector as shown in FIG. 1. Alternatively, to avoid the problem that the distance between the inlet and the outlet is short, the fourth region may be designed so as not to extend to the vicinity of the center of the end plate 18. For example, the fourth region may be formed in the outer ⅔ region in the radial direction in the end plate 18 (In this case, no openings are formed in the turns of the first passage, which run in the vicinity of the center). The openings may preferably be formed in all of the turns of the second passage, which cross the fourth region. However, if the openings are formed in not less than about 80% of the turns of the second passage, which cross the fourth region, there is substantially no problem. Although the size of the openings is not restricted, if it is too small, the throughput is small, and if it is too large, the distance of the passage between the inlet and the outlet in which heat exchange is carried out is short (the amount of the fluid to be processed in a unit area of the wall is large), so that the heat-exchanging efficiency is low. Thus, the size of the openings may preferably be about 15 to 60 degrees in terms of the central angle (the angle formed by the both edges of the arc in the circumferential direction of the opening and the center of the end plate).

In the embodiment shown in FIG. 1, the second passage inlet 30 is formed in the right side of the end plate 16, and the second passage outlet 34 is formed in the left side of the end plate 18, so that the second passage inlet 30 and the second passage outlet 34 are formed at positions shifted by about 180 degrees from each other. The positional relationship between the second passage inlet 30 and the second passage outlet 34, however, is not restricted thereto, and an arbitrary positional relationship may be employed. However, if the fluid entering from the inlet, is discharged immediately from the outlet, the heat-exchanging efficiency is low. Therefore, it is preferred to arrange the inlet and the outlet such that the fluid entering from the second passage inlet is discharged from the second passage outlet after passing through the second passage preferably for about 120 to 340 degrees, more preferably for about 150 to 340 degrees. In any event, the fluid entering from the second passage inlet 30 is discharged from the second passage outlet 34 after passing through the second passage 12 for less than one turn only (i.e., less than 360 degrees). In cases where the inlet and the outlet are arranged at positions shifted in an amount which is not about 180 degrees, it is preferred to give an initial velocity to the fluid supplied to the inlet, in the direction for passing through the longer passage, in order to prevent the fluid from being discharged from the outlet after passing through the shorter part of the passage. If it is desired to avoid such complexity, it is preferred to arrange the second passage inlet 30 and the second passage outlet 34 at the positions shifted by about 180 degrees (i.e., 150 to 210 degrees) as shown in FIG. 1.

It should be noted that in the embodiment shown in FIG. 1, although the second passage inlet 30 and the second passage outlet 34 are formed in the different end plates, they may also be formed in the same end plate. Further, in the embodiment shown in FIG. 1, although the second passage inlet 30 and the first passage inlet 22 are formed in the same end plate, they may be formed in the different end plates. That is, the first passage inlet, the first passage outlet, the second passage inlet and the second passage outlet may be formed in any of the end plates, and any of the inlets and outlets may be formed in any of the end plates. However, it is preferred to arrange the inlets and outlets such the two fluids flow in the counter directions.

Method for operation will now be described. A first fluid to be subjected to heat exchange is supplied to the first region 20. This may be carried out by air-tightly connecting a duct not shown to the outer periphery of the first region 20, and the first fluid is supplied to the first region 20 through this duct. Since the end plate is flat, the connection with the duct may easily be attained. Upon supplying the first fluid to the first region 20, as shown by the broken arrows in FIG. 1, the first fluid enters the first passage 10 through the first passage inlet 22. The first fluid passes through the first passage 10 for only about half turn, and is then discharged from the first passage outlet 26. Simultaneously, a second fluid is supplied to the third region in the same manner. As shown by the solid arrows in FIG. 1, the supplied second fluid enters the second passage 12 from the second passage inlet 30, and is discharged from the second passage outlet 34 after passing through the second passage 12 for only about half turn. It is preferred to make the first and second fluids flow in counter directions as shown in FIG. 1. This may easily be attained by arranging the first passage inlet 22 and the second inlet passage 30 at the positions shifted by 180 degrees from each other.

During the first and second fluids pass through the first passage 10 and the second passage 12, respectively, heat exchange is carried out therebetween via the walls 14.

Figure 2:
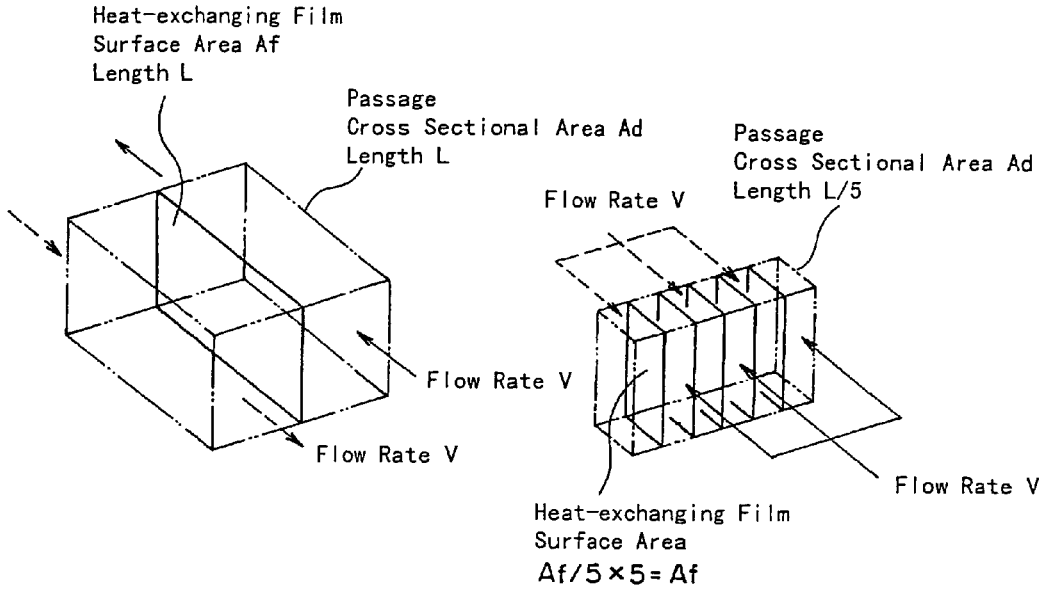
FIG. 2 is a drawing for explaining the heat exchanging efficiency of the heat exchanger according to the present invention.

The heat-exchanging efficiency is about the same as that with the conventional spiral heat exchangers, while since each fluid passes through the passage for only less than 1 turn, the pressure loss is small and the throughput is largely increased. This will now be described referring to FIG. 2. As shown in FIG. 2, a heat-exchanging film having a surface area of Af is placed in the center portion of a passage having a cross sectional area of Ad and a length of L, and fluids, each of which has a flow rate of V, flow in counter directions. The heat-exchanging efficiency of this heat exchanger is expressed as V/Af and the pressure loss is expressed as V/Ad×L. Another heat exchanger comprising 5 heat-exchanging films each of which has a cross sectional area of Af/5, placed in a passage having the same cross sectional area as described above and having the length of ⅕ of that of the passage mentioned above will now be considered. In this heat exchanger, fluids, each of which has a flow rate of V, flow in counter directions (the difference in the temperatures between the fluids are the same as in the case described above). The heat-exchanging efficiency in this case is V/((Af/5)×5)=V/Af which is the same as that of the heat exchanger described above, while the pressure loss is (V/Ad×L)×⅕ which is the ⅕ of that of the heat exchanger described above (the thickness of the films is ignored). That is, since the heat-exchanging efficiency varies depending on the flow rate of the fluid to be processed per a unit area of the heat-exchanging film if the difference in the temperatures of the two fluids introduced is constant, a heat exchanger having the same level of heat-exchanging efficiency but having a low pressure loss is attained by dividing the heat-exchanging film and to shorten the length of the passage. In other words, a heat exchanger which has the same heat-exchanging efficiency but which can process a large amount of fluids may be attained by increasing the areas of the inlets and outlets of the fluids without changing the area of the heat-exchanging film.

Figure 3:
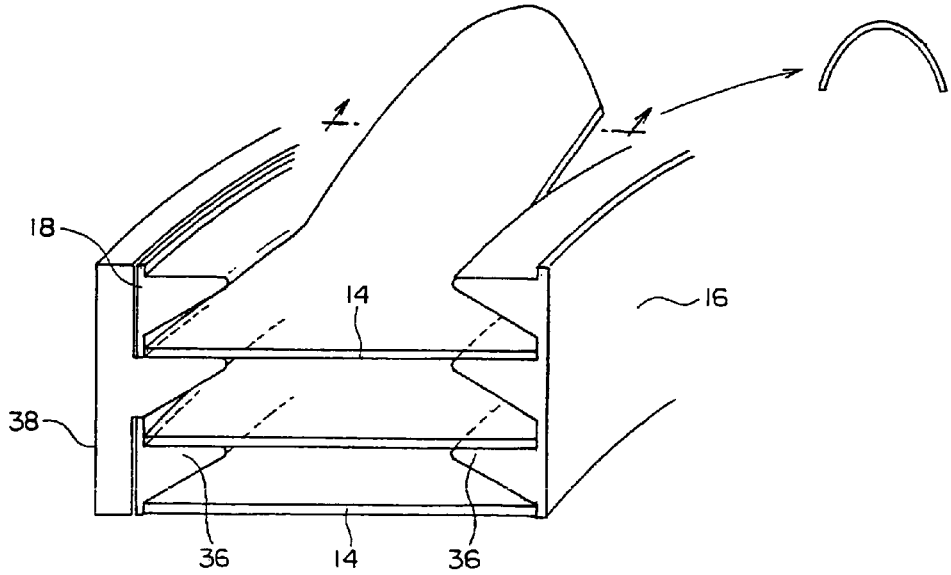
FIG. 3 is a drawing for explaining a method for producing the heat exchanger according to the present invention.

An example of the method for preparing the heat exchanger according to the present invention will now be described. On each of the first and second end plates 16 and 18, a spiral ridge 36 is formed. These end plates are held in parallel such that the sides on which the ridges 36 are formed face each other. Two films made of a material having flexibility and elasticity are stacked, and the films are wound such that that each film contacts the ridges while bending the films such that central portion in the direction perpendicular to longitudinal direction of the films protrudes to the outer direction of the spiral (see FIG. 3). In the present specification, the term "elasticity" means that when the film is bent such that central portion in the direction perpendicular to longitudinal direction of the films protrudes to the outer direction of the spiral, the film exerts force to restore to the original shape. The two films are wound about different ridges, so that the separated first and second passages are formed (see FIG. 1). By bending the films as mentioned above, the longer sides of the films can get over the ridges, so that the films may be wound from the center of the spiral to the outer part thereof. To wind the films while bending the films as mentioned above, a jig which enables to keep the films in such a bent state may be used. That is, by preparing a jig having a doglegged slit, and by carrying out the winding operation while inserting each film into the slit, the winding of the films while bending the films as mentioned above may be attained. To make it easy for the films to get over the ridges 36, it is preferred to form each ridge 36 such that the inner side of the ridge is sloped as shown in FIG. 1. The outer side of the ridge 36 preferably stands up perpendicularly to the end plate. By this, the film is fixed along the outer side of the ridge 36. This is shown in FIG. 3. Since the ridge 36 cannot be formed on the openings in the end plate, it is preferred to place a guide plate 38 from the outside of the end plate, which guide plate 38 gives ridges 36 to the openings in the end plate. Further, as shown in FIG. 1, at the start point and the end point of the spiral, it is preferred to air-tightly seal the passages by stacking the two films and to wind the stacked films about the same ridge for one to several turns. By this operation, the start point and the end point of the two films may be substantially air-tightly sealed even if an additional treatment such as treatment with an adhesive is not performed. After completion of the winding, the guide plate 38 is removed, and the end portions of the films and the ridges 36 are air-tightly bound. This may be carried out by, for example, a method by welding under heat by, for example, generating heat at the connecting portions of the films and the plates by ultrasonication or the like; a method in which the connecting portion are immersed in a solvent which dissolves the films and/or the ridges so as to weld them; or by a method in which an adhesive is applied to the edges of the long sides of the films and by adhering the connecting portions. Further, a groove adjacent to the outer side of each ridge may be provided, and the air-tightness may be further improved by inserting the films into the grooves.

Figure 4:
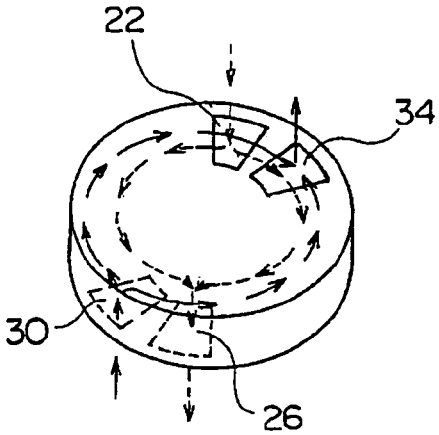
FIG. 4 is a schematic view showing another embodiment of the present invention.
Figure 5:
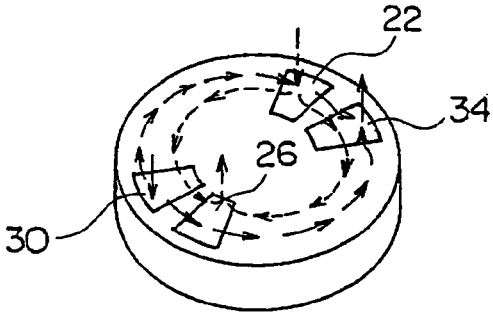
FIG. 5 is a schematic view showing still another embodiment of the present invention.
Figure 6:
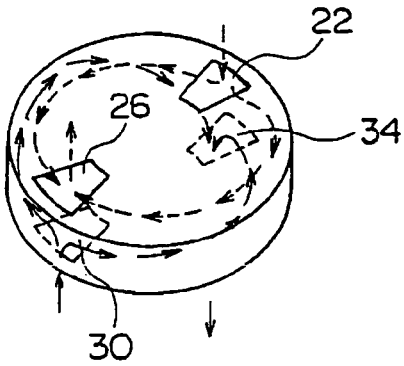
FIG. 6 is a schematic view showing still another embodiment of the present invention.

Other modes of the above-described present invention are shown in FIGS. 4 to 6. In FIGS. 4 to 6, as for the regions in which the openings are formed, only the regions are shown and the openings formed therein are not shown. The spiral passages are also not shown. In the embodiment shown in FIG. 4, the first passage inlet and the second passage outlet are formed in the first end plate, and the first passage outlet and the second passage inlet are formed in the second end plate. In the embodiment shown in FIG. 5, all openings are formed in the first end plate. In the embodiment shown in FIG. 6, the first passage inlet and the first passage outlet are formed in the first end plate, and the second passage inlet and the second passage outlet are formed in the second end plate.

Figure 7:
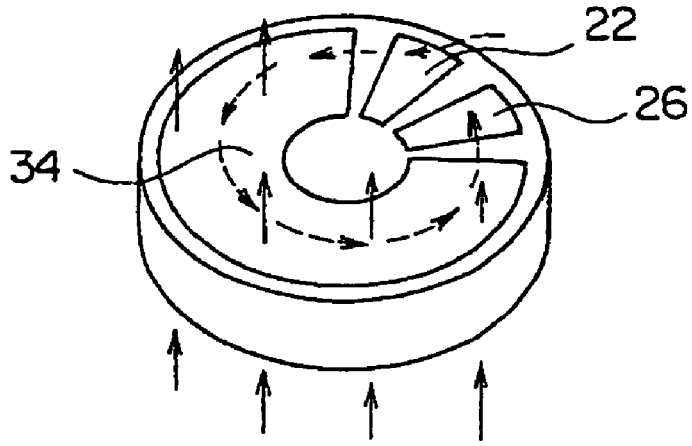
FIG. 7 is a schematic view showing a preferred embodiment of the present invention.

A second invention (claim 5) will now be described referring to FIG. 7. In FIG. 7, as in FIGS. 4 to 6, only the regions in which the openings are formed are shown and the openings formed therein are not shown. The spiral passages are also not shown. The spiral first and second passages, the first and the second end plates and the first passage inlet 22 and the first passage outlet 26 are the same as in the first invention shown in FIG. 1. In the embodiment shown in FIG. 7, the second passage inlet and the second passage outlet 34 are formed in large regions in the different end plates, respectively. That is, the third region and the fourth region described in the first invention are large. Although the second passage inlet is not shown in FIG. 7, a region of openings, which has the same size as the second passage outlet 34 is provided on the same position in the second end plate. The size of the second passage inlet and the second passage outlet 34 is not restricted, and may preferably be about 240 to 300 degrees in terms of central angle. The second passage inlet and the second passage outlet may be divided. In the second invention, except for the size of the second passage inlet and the second passage outlet, the constitution and preferred mode are the same as those of the above-described first invention.

Method for operation will now be described. In the same manner as in the first invention described referring to FIG. 1, a first fluid is supplied to the first passage from the first passage inlet 22. The first fluid which entered the first passage is discharged from the first passage outlet 26 after passing through the first passage for only less than one turn. On the other hand, a second fluid is supplied from the second passage inlet and is discharged from the second passage outlet 34 after passing through the second passage in the axial direction. During this period of time, heat is exchanged between the first and the second fluids.

Figure 8:
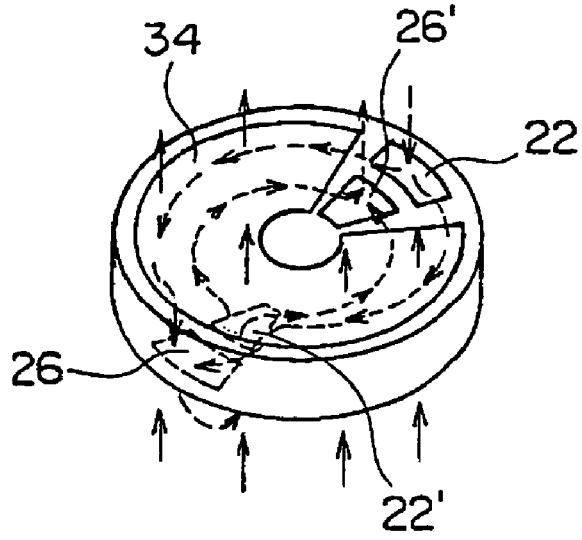
FIG. 8 is a schematic view showing another preferred embodiment of the present invention.

A third invention (claim 8) will now be described referring to FIG. 8. In FIG. 8, as in FIGS. 4 to 6, only the regions in which the openings are formed are shown and the openings formed therein are not shown. The spiral passages are also not shown. The spiral first and second passages, and the first and the second end plates are the same as in the first invention. In the third invention, a first inlet 22 of the first passage is formed at about an outer half or about an inner half of a continuous area along radial direction in the first end plate, and the first outlet 26 of the first passage is formed at about an outer half or about an inner half of a continuous area along radial direction in the first or second end plate. In this case, when the first inlet 22 of the first passage is formed at about the outer half in the radial direction in the first end plate, the first outlet 26 of the first passage is also formed at about the outer half in the radial direction in the first or second end plate. When the first inlet 22 of the first passage is formed at about the inner half in the radial direction in the first end plate, the first outlet 26 of the first inlet is also formed at about the inner half in the radial direction in the first or second end plate. A second inlet 22' of the first passage, which opens only to the first passage, is formed, and is air-tightly connected to the first outlet 26 of the first passage via a duct not shown. When the first inlet 22 of the first passage is formed at about an outer half in the radial direction, the second inlet 22' of the first passage is formed at about an inner half of in the radial direction of the first or second end plate. When the first inlet 22 of the first passage is formed at about an inner half in the radial direction of the first end plate, the second inlet 22' of the first passage is formed at about outer half in the radial direction of the first or second end plate. Further, a second outlet 26' of the first passage is formed. When the second inlet 22' of the first passage is formed at about the outer half in the direction in the first end plate, the second outlet 26' of the first passage is also formed at about the outer half in the radial direction in the first or second end plate. When the second inlet 22' of the first passage is formed at about the inner half in the radial direction in the first end plate, the second outlet 26' of the first passage is also formed at about the outer half in the radial direction of the first or second end plate.

In the embodiment shown in FIG. 8, a second passage inlet and a second passage outlet 34 are formed in large regions in the different end plates, respectively. That is, the third region and the fourth region described in the first invention are large. Although the second passage inlet is not shown in FIG. 8, a region of openings, which has the same size as the second passage outlet 34, is provided at the same position in the second end plate. The size of the second passage inlet and the second passage outlet 34 is not restricted, and may preferably be about 240 to 300 degrees in terms of central angle. The second passage inlet and the second passage outlet may be divided. In the third invention, except for that there are two inlets and outlets, respectively, in the first passage and except for the size of the second passage inlet and the second passage outlet, the constitution and preferred mode are the same as those of the above-described first invention.

Method for operation will now be described. A first fluid is supplied to the first passage from the first inlet 22 of the first passage. The first fluid entered the first passage is discharged from the first outlet 26 of the first passage after passing through the first passage for less than one turn (in the embodiment shown in FIG. 8, about half turn). The discharged first fluid passes through the duct not shown and enters the first passage from the second passage 22' of the first passage. The first fluid then passes through the first passage for less than one turn (in the embodiment shown in FIG. 8, about half turn), and is discharged from the second outlet 26' of the first passage. During this period of time, heat is exchanged between the first and the second fluids.

The heat exchanger according to the second or third invention may also be produced by the method similar to the heat exchanger according to the first invention.

The heat exchanger according to the present invention may be applied to any use in which heat is exchanged between fluids. The fluid may be either gas or liquid. An example of the preferred uses is the case wherein the heat exchanger is applied to a dehumidifier.

That is, the present invention provides a dehumidifier according to the present invention. In the conventional dehumidifiers, since a dehumidification element is regenerated with heated air, and the air used for regeneration is cooled to condense, heat is exchanged between the air before being heated and the air after being used for regeneration. The heat exchanger according to the present invention may preferably be employed as such a heat exchanger of the dehumidifier. That is, the present invention provides a dehumidifier comprising at least a casing, a dehumidification element held in the casing; a heater which heats air for regeneration of the dehumidification element; a heat exchanger for exchanging heat between the air for regeneration after regenerating the dehumidification element, which air is hot and humid, and the air for regeneration before being heated; and/or a heat exchanger for cooling the hot and humid air for regeneration after regenerating the dehumidification element, or for further recovering heat therefrom, wherein the heat exchanger(s) is(are) the heat exchanger according to the present invention. Such a dehumidifier per se (the heat exchanger is a conventional one) is well-known and is described in, for example, U.S. Pat. No. 6,083,304 (U.S. Pat. No. 6,083,304 is hereby incorporated by reference). By applying the heat exchanger of the present invention to a dehumidifier, even if the heat exchange is carried out with a smaller pressure than in the conventional apparatus, about the same or more heat-exchanging efficiency may be attained, so that the consumption of power may be saved, and the motor can be made compact.

What is claimed is:

1. A heat exchanger comprising a first spiral passage; a second spiral passage formed along said first passage, which is adjacent to said first passage via walls; first and second end plates which cover both end faces of said first and second passages, respectively; a first passage inlet consisting essentially of a group of openings formed in a first region continuous along radial direction in said first end plate, which openings are open only to said first passage; a first passage outlet consisting essentially of a group of openings formed in a second region continuous along radial direction in said first or second end plate, which openings are open only to said first passage; a second passage inlet consisting essentially of a group of openings formed in a third region continuous along radial direction in said first or second end plate, which third region is located at an area other than said first and second regions, which openings are open only to said second passage; and a second passage outlet consisting essentially of a group of openings formed in a fourth region continuous along radial direction in said first or second end plate, which fourth region is located at an area other than said first and second regions, and is formed in the first or second end plate other than the one in which said second passage inlet is formed, which openings are open only to said second passage; said first passage being tightly closed except for said first passage inlet and said first passage outlet; said second passage being tightly closed except for said second passage inlet and said second passage outlet; a first fluid entering said first passage from said first passage inlet being discharged from said first passage outlet after passing through said first passage for less than one turn only; a second fluid entering said second passage from said second inlet being discharged from said second passage outlet after passing through said second passage in axial direction; heat being exchanged between said first and second fluids through said walls during said first and second fluids pass through said first and second passages, respectively.

2. The heat exchanger according to claim 1, wherein said second passage inlet and said second passage outlet are formed in substantially the entire area in each of said end plates, respectively, which area is other than said first and second regions.

3. The heat exchanger according to claim 1, wherein said first passage inlet opens to substantially all turns of said first passage crossing said first region; said first passage outlet opens to substantially all turns of said first passage crossing said second region; said second passage inlet opens to substantially all turns of said second passage crossing said third region; and said second passage outlet opens to substantially all turns of said second passage crossing said fourth region.

* * * * *